US005219122A

United States Patent [19]

Iwanaga

[11] Patent Number: 5,219,122

[45] Date of Patent: Jun. 15, 1993

[54] FUEL INJECTION SYSTEM FOR ENGINE

[75] Inventor: Takashi Iwanaga, Toyohashi, Japan

[73] Assignee: Nippondenso Co., Ltd., Kariya, Japan

[21] Appl. No.: 936,650

[22] Filed: Aug. 28, 1992

[30] Foreign Application Priority Data

Aug. 30, 1991 [JP] Japan ..... 3-219506
Sep. 17, 1991 [JP] Japan ..... 3-235902

[51] Int. Cl.[5] ..... F02M 51/00

[52] U.S. Cl. ..... 239/533.8; 239/585.1; 239/900; 123/446

[58] Field of Search ..... 239/88, 533.3, 533.4, 239/533.5, 533.8, 585.1; 123/446, 467

[56] References Cited

U.S. PATENT DOCUMENTS 4,545,352 10/1985 Jourde et al. ..... 123/447
4,669,668 6/1987 Ogawa .
4,784,102 11/1988 Igashira et al. ..... 123/447
4,946,103 8/1990 Ganser ..... 239/88
4,951,631 8/1990 Eckert ..... 123/446
4,971,016 11/1990 Peters et al. ..... 123/446 X
4,986,472 1/1991 Warlick et al. ..... 239/533.8 X
4,987,887 1/1991 Kelly ..... 123/446 X

FOREIGN PATENT DOCUMENTS 0393390 10/1990 European Pat. Off. .
0459429 12/1991 European Pat. Off. .
2534976 10/1982 France .
2-252963 10/1990 Japan .

*Primary Examiner*—Andres Kashnikow
*Assistant Examiner*—Lesley D. Morris
*Attorney, Agent, or Firm*—Cushman, Darby & Cushman

[57] ABSTRACT

A feel injection system for an engine controls a behavior of a nozzle needle for controlling a fuel injection timing and a fuel injection amount. The system controls a hydraulic pressure applied to the nozzle needle for displacing the nozzle needle between its fully opened position and its fully closed position. The system so controls the hydraulic pressure applied to the nozzle needle as to quickly displace the nozzle needle from the fully opened position to a given position which is located between the fully opened and closed positions, on the other hand, slowly displace the nozzle needle from the given position to the fully closed position so as to decrease an impact load applied to a valve seat for the nozzle needle when the nozzle needle is seated onto the valve seat.

16 Claims, 10 Drawing Sheets

FUEL INJECTION SYSTEM FOR ENGINE

BACKGROUND OF THE INVENTION

1. Field of the Invention

The present invention relates generally to a fuel injection system for an engine, and more specifically, to a common-rail fuel injection system for a diesel engine.

2. Description of the Prior Art

Common-rail fuel injection systems have been known as disclosed in such as Japanese First (unexamined) Patent Publication No. 59-165858 and U.S. Pat. No. 4,545,352 which is an equivalent of the former. In the common-rail fuel injection systems, high pressure fuel is accumulated in a so-called common rail working as a surge tank to be injected into engine cylinders via opening and closing operations of respective fuel injectors.

As shown in FIG. 1, a common-rail fuel injection device 100 of this type includes an injection nozzle 101 through which the high pressure fuel from the common rail is injected into the corresponding engine cylinder, and a three-way solenoid valve 102 which controls a fuel injection timing and a fuel injection amount.

The injection nozzle 101 includes a nozzle needle 103 operative to open and close injection holes, a hydraulic piston 104 operative to drive the nozzle needle 103, and a control chamber 105 operative to control a hydraulic pressure to be applied to the hydraulic piston 104. As shown in FIG. 2, a pressure control valve 107 is provided in the control chamber 105. The pressure control valve 107 is formed with an orifice 109 extending through the pressure control valve 107 at its center. A reference numeral 108 denotes a portion of the three-way solenoid valve 102, defining a communication passage 106 and working as a valve seat for the pressure control valve 107.

Practically, the orifice 109 only works to control the flow of the hydraulic pressure from the control chamber 105 into the communication passage 106 of the three-way solenoid valve 102 as will be clear from the following explanation with reference to FIG. 3.

FIG. 3 is a timechart showing a relationship among a hydraulic pressure in the control chamber 105, a lift position of the nozzle needle 103 and a load applied to a value seat for the nozzle needle 103.

At the start of the fuel injection, which corresponds to FIG. 2, the three-way solenoid valve 102 allows the communication passage 106 to communicate with a low pressure side. Accordingly, the pressure control valve 107 is seated on the valve seat 108 to allow the high pressure fuel within the control chamber 105 to slowly flow out via the orifice 109 in a controlled fashion, as shown in part (A) of the graph in FIG. 3. When the hydraulic pressure in the control chamber 105 drops to a value opening pressure for the nozzle needle 103, the hydraulic piston 104 starts to slowly go up resulting in lifting up the nozzle needle 103 as shown in part (B) of the graph in FIG. 3. This means that the nozzle needle 103 starts to separate from its valve seat in a nozzle body 110 to allow the start of the fuel injection via the injection holes into the corresponding engine cylinder.

On the other hand, at the end of the fuel injection, the three-way solenoid valve 102 allows the communication passage 106 to communicate with a high pressure side, i.e. the common rail. Accordingly, the high pressure fuel is applied to the pressure control valve 107 to urge the same toward the hydraulic piston 104. Thus, the pressure control valve 107 is separated from the valve seat 108 to allow immediate introduction of the high pressure fuel into the control chamber 105 via an annular gap formed between the outer periphery of the pressure control valve 107 and the peripheral wall of the control chamber 105. Accordingly, in this case, the orifice 109 does not function to control the flow of the orifice 109 does not function to control the flow of the high pressure fuel from the communication passage 106 into the control chamber 105. As a result, as shown in part (A) of the graph in FIG. 3, the pressure in the control chamber 105 immediately increases to a valve closing pressure for the nozzle needle 103. This leads to a quick overall downward movement of the hydraulic piston 104 to force the nozzle needle 103 onto the valve seat in the nozzle body 110.

With the foregoing structure, the prior art common-rail fuel injection systems are capable of providing the desirable so-called delta type fuel injection characteristics, that is, the fuel injection rate is small at the start of the injection and gradually gets larger, while, the sharp cut-off of the fuel injection is attained at the end of the injection.

The prior art common-rail injection systems, however, have the following problems.

As described above, the high pressure fuel is immediately introduced into the control chamber 105 at the end of the fuel injection. Accordingly, as shown in part (A) of the graph in FIG. 3, the hydraulic pressure in the control chamber 105 inevitably becomes overshot so that the nozzle needle 103 is forced down to a level exceeding a position of the nozzle needle 103 at the start of the fuel injection, as shown in part (B) of the graph in FIG. 3. This causes disadvantages that an excessive impact load P={(upper peak value)−(lower peak value)} is applied to the valve seat for the nozzle needle 103, as shown in part (c) of the graph in FIG. 3.

This necessitates associated portions around the valve seat in the nozzle body 110 to be made thicker so as to provide strength large enough against the applied impact load P. Mere provision of the larger thickness around the valve seat, however, inevitably increases a length of each injection hole so that an increased resistance against the flow of the injected fuel is resulted. On the other hand, in order to avoid such an increased resistance with the increased thickness, a volume of a sack chamber 111 should be enlarged. This, however, causes the following problems.

The sack chamber 111 is located downstream of the valve seat for the nozzle needle 103 and is formed with the injection holes at its downstream end portions. Accordingly, the fuel in the sack chamber 111 is likely to flow out into the corresponding engine cylinder via the injection holes even after the completion of the fuel injection, i.e. even after the nozzle needle 103 is seated on the valve seat. This means that the enlarged volume of the sack chamber 111 may lead to serious disadvantages such as increases of fuel consumption rate, exhaust gas temperature and hydrocarbon. In the circumstances, enlarging the thickness around the valve seat cannot be taken as measures for solving the problem of the excessive impact load P in view of the other serious problems caused therefrom.

SUMMARY OF THE INVENTION

Therefore, it is an object of the present invention to provide an improved fuel injection system for an engine that can eliminate the above-noted defects inherent in the prior art.

To accomplish the above-mentioned and other objects, according to one aspect of the present invention, a fuel injection system for an engine comprises fuel injection means including a valve member and a valve seat, the valve member movable between a first position where the valve member is separated from the valve seat to allow a fuel injection via an injection opening into the engine, and a second position where the valve member is seated on the valve seat to inhibit the fuel injection via the injection opening; and control means for controlling a hydraulic pressure applied to the valve member to displace the valve member between the first and second positions; the control means immediately increasing the hydraulic pressure applied to the valve member when the valve member is displaced from the first position to a third position which is located between the first and second positions, and gradually increasing the hydraulic pressure applied to the valve member when the valve member is displaced from the third position to the second position.

According to another aspect of the present invention, a fuel injection system for an engine comprises fuel injection means including a valve member and a valve seat, the valve member movable between a first position where the valve member is separated from the valve seat to allow a fuel injection via an injection opening into the engine, and a second position where the valve member is seated on the valve seat to inhibit the fuel injection via the injection opening; and control means for controlling a hydraulic pressure applied to the valve member to displace the valve member between the first and second positions, the control means controlling the hydraulic pressure so as to quickly displace the valve member from the first position to a third position which is located between the first and second positions and slowly displace the valve member from the liquid position to the second position.

BRIEF DESCRIPTION OF THE DRAWINGS

The present invention will be understood more fully from the detailed description given hereinbelow and from the accompanying drawings of the preferred embodiments of the invention, which are given by way of example only, and are not intended to be limitative of the present invention.

In the drawings

Figure 5:
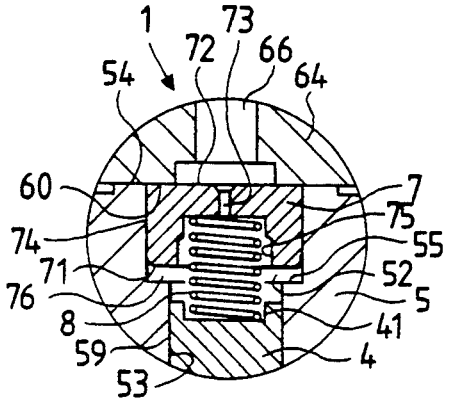
FIG. 5 is a sectional view showing a portion of the fuel injection system in FIG. 4, wherein an arrangement of associated members for controlling a hydraulic pressure applied to a hydraulic piston is shown.
Figure 7:
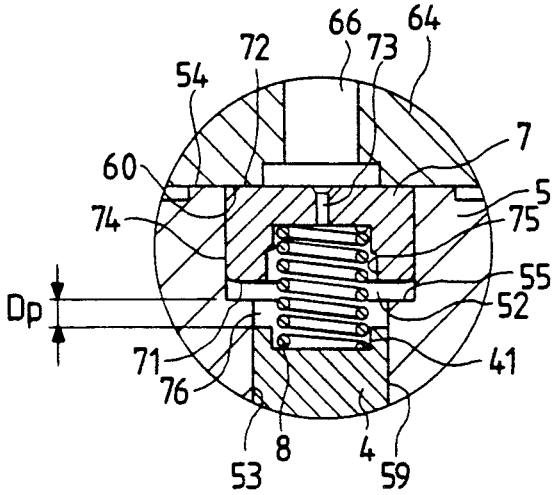
Figure 8:
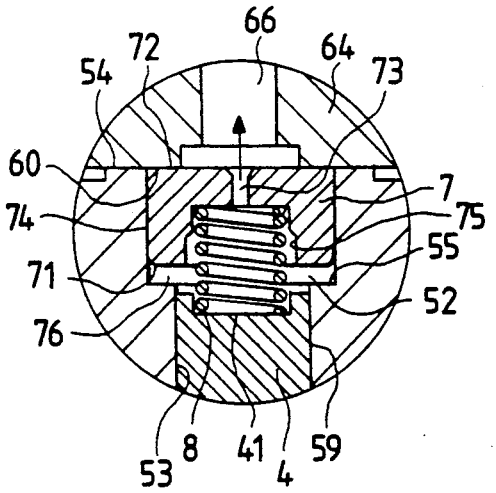
Figure 9:
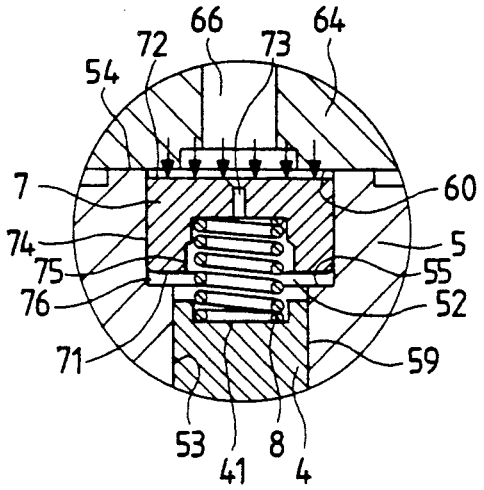
Figure 10:
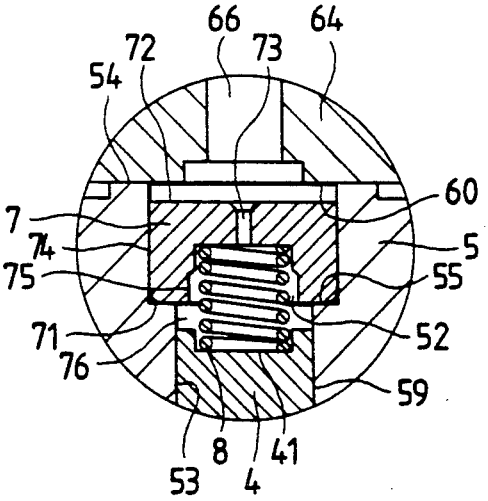
Figure 11:
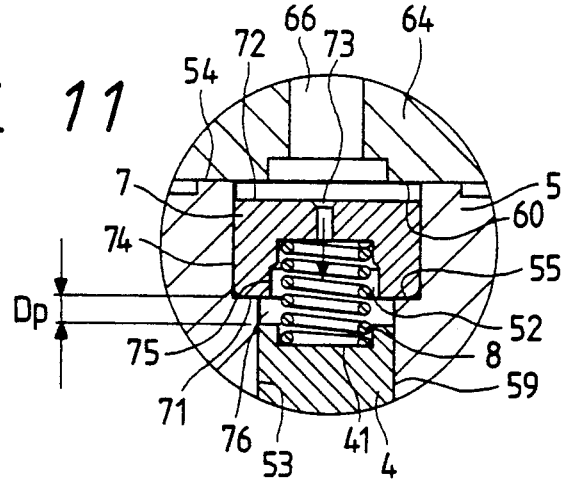
Figure 12:
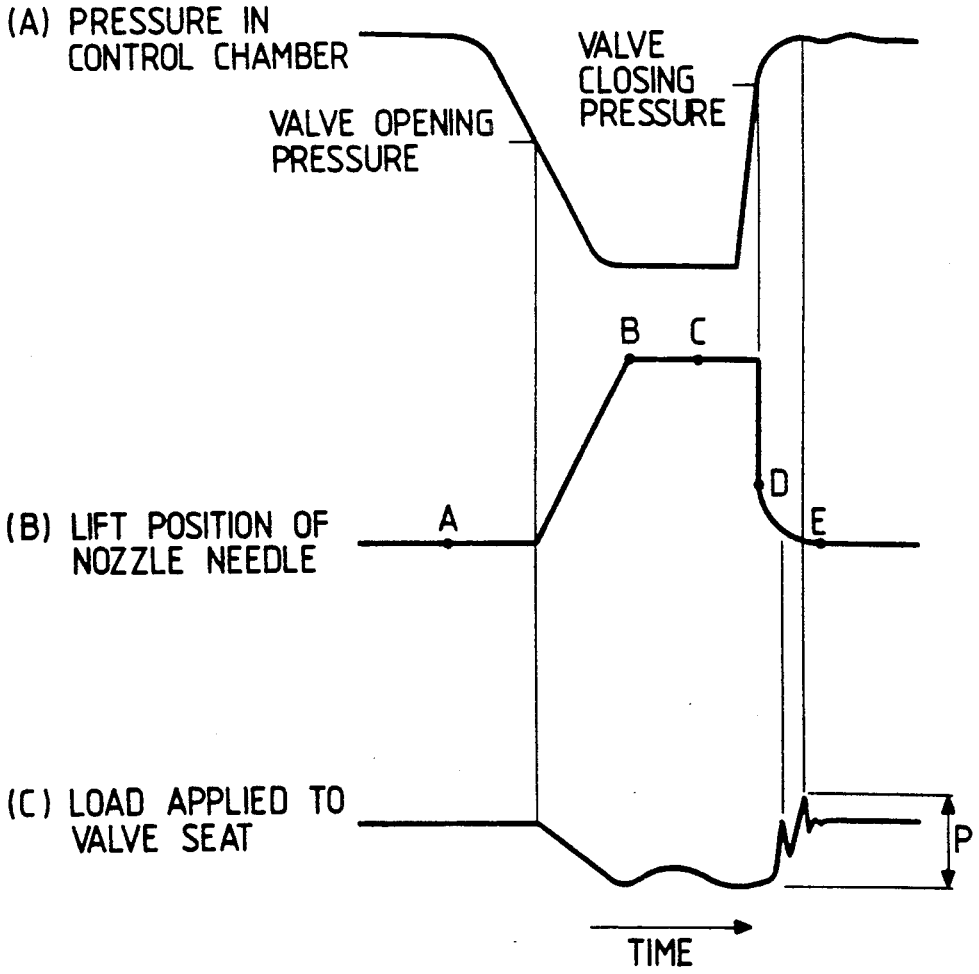
Figure 13:
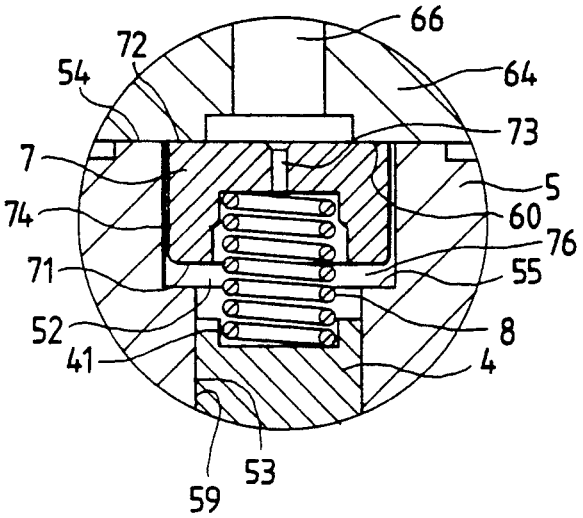
Figure 14:
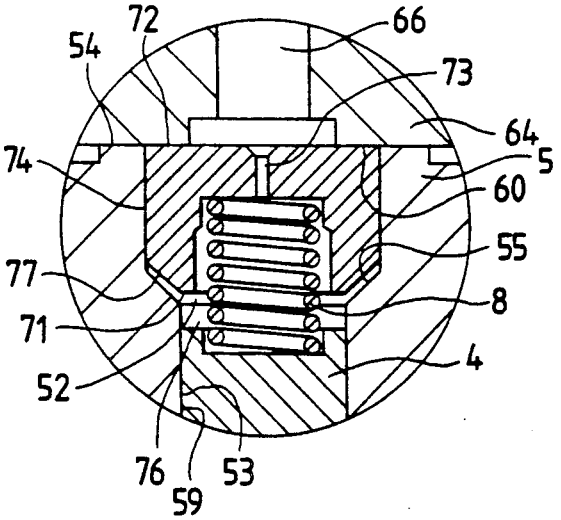
Figure 15:
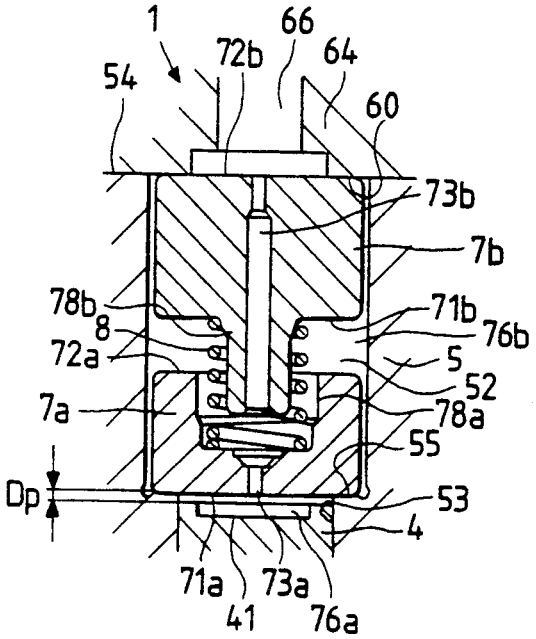
Figure 16:
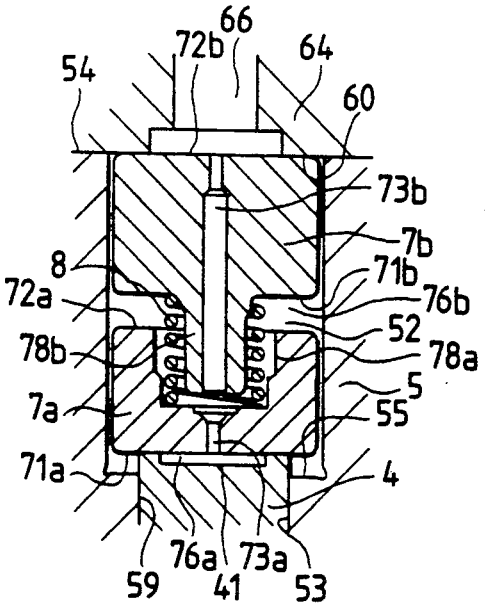
Figure 17:
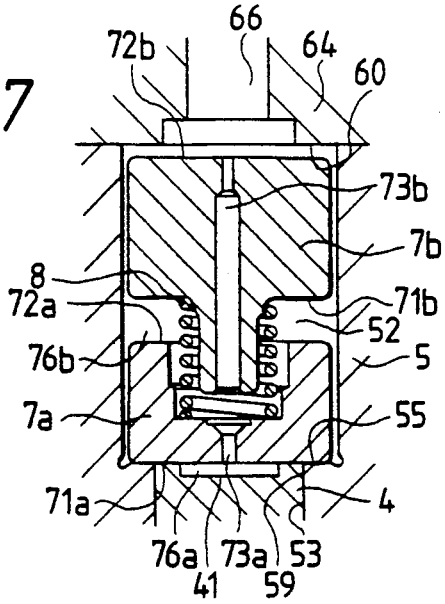
Figure 18:
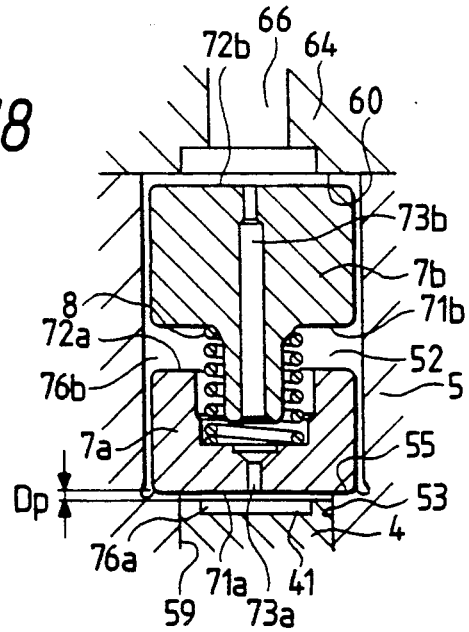
Figure 19:
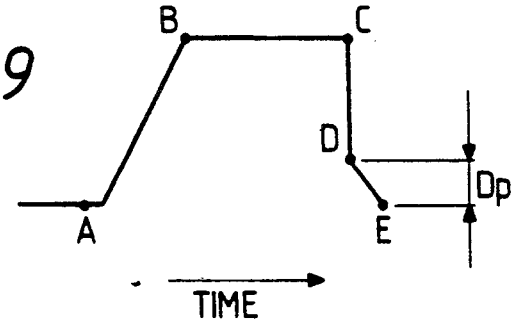

FIG., 7 is a sectional view showing the arrangement in FIG. 5, wherein one operating state of the associated members for controlling the hydraulic pressure applied to the hydraulic piston is shown;

FIG. 8 is a sectional view showing another operating state of the associated members in FIG. 7;

FIG. 9 is a sectional view showing still another operating state of the associated members in FIG. 7;

FIG. 10 is a sectional view showing a further operating state of the associated members in FIG. 7;

FIG. 11 is a sectional view showing a still further operating state of the associated members in FIG. 7;

FIG. 12 is a timechart showing a relationship of variations among a hydraulic pressure in a pressure control chamber, a lift position of the nozzle needle and a load applied to a valve seat for the nozzle needle, according to the first preferred embodiment of the present invention;

FIG. 13 is a sectional view showing a modification of the arrangement in FIG. 7;

FIG. 14 is a sectional view showing another modification of the arrangement in FIG. 7;

FIG. 15 is a sectional view showing one operating state of an arrangement of associated members for controlling a hydraulic pressure applied to a hydraulic piston according to a second preferred embodiment of the present invention;

FIG. 16 is a sectional view showing another operating state of the associated members in FIG. 15;

FIG. 17 is a sectional view showing still another operating state of the associated members in FIG. 15;

FIG. 18 is a sectional view showing a further operating state of the associated members in FIG. 15; and FIG. 19 is a timechart showing variations in a lift position of a nozzle needle, according to the second preferred embodiment of the present invention.

DESCRIPTION OF THE PREFERRED EMBODIMENT

Referring now to the drawings, a first preferred embodiment of a fuel injection system for an engine according to the present invention will be described with reference to FIGS. 4 to 12.

Figure 4:
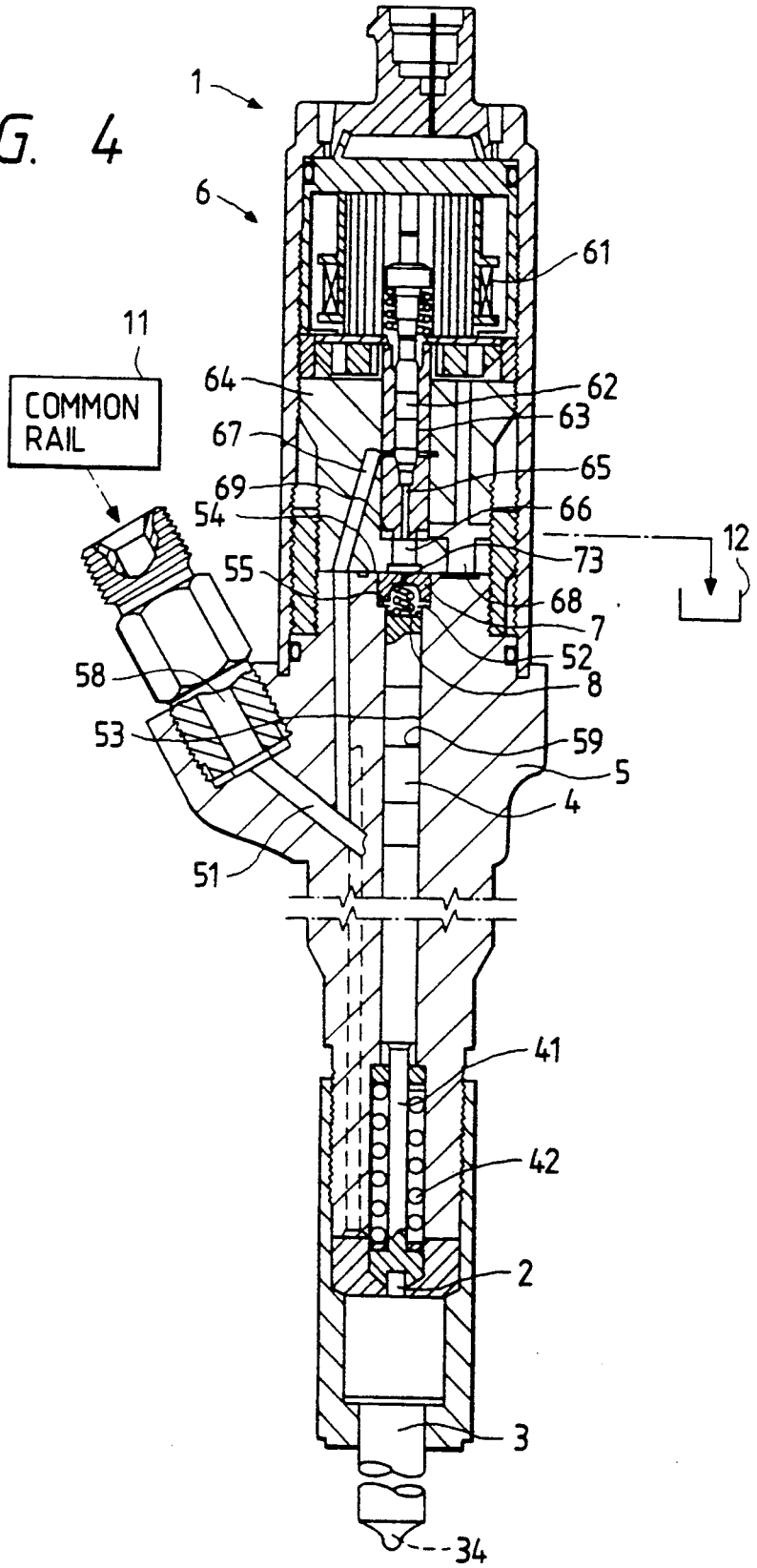
FIG. 4 is a sectional view showing a common-rail fuel injection system for a diesel engine according to a first preferred embodiment of the present invention.

FIG. 4 shows a common-rail fuel injection system for a diesel engine according to the first preferred embodiment. A fuel injection device 1 is provided for each engine cylinder (not shown) and constantly fed with the high pressure fuel at an inlet port 58 from an common rail 11. The common rail 11 works as a pressure accumulator for storing the high pressure fuel supplied from a high pressure fuel supply pump (not shown) and feeds the high pressure fuel to each of the fuel injection devices 1.

The fuel injection device 1 includes a nozzle needle 2, a nozzle body 3, a hydraulic piston 4 and a nozzle holder 5, which cooperatively constitute an injection nozzle. The fuel injection device 1 further includes a three-way solenoid valve 6.

Figure 6:
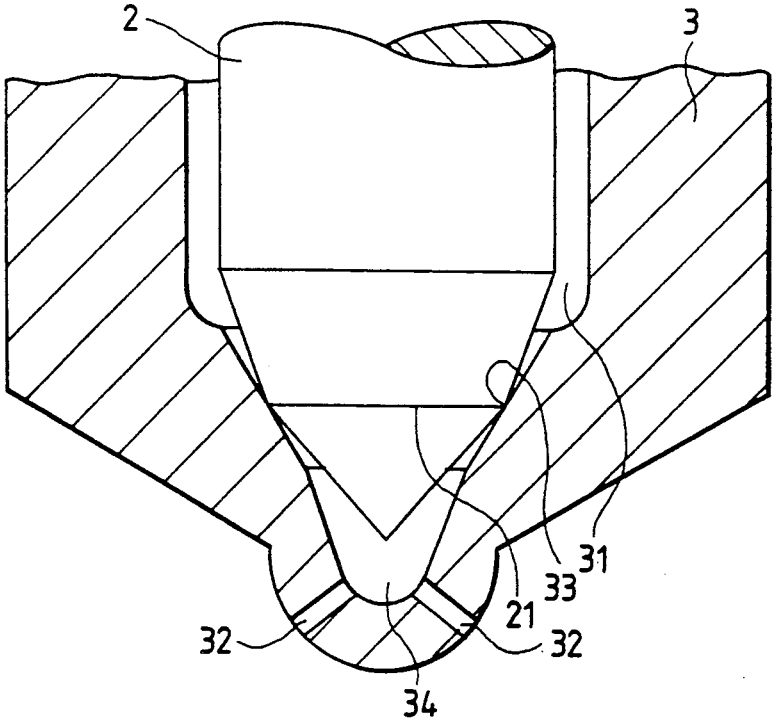
FIG. 6 is a sectional view showing portions of a nozzle body and a nozzle needle incorporated in the fuel injection system in FIG. 4.

The nozzle needle 2 is slidably received in the nozzle body 3 and, as shown in FIG. 6, formed at one of two longitudinal ends with a stepped contact portion 21 which is selectively seated on and separated from a valve seat 33 of the nozzle body 3 by means of the operation of the hydraulic piston 4. Specifically, the nozzle needle 2 is mechanically connected at its other longitudinal end to the hydraulic piston 4. When the hydraulic piston 4 is forced toward the three-way solenoid valve 6, the contact portion 21 is separated from the valve seat 33, on the other hand, when the hydraulic piston 4 is forced toward the nozzle needle 2, the contact portion 21 is seated onto the valve seat 33.

As shown in part (B) of the graph in FIG. 12, the nozzle needle 2 is lifted up and down between levels A and E during the fuel injection, i.e. between the beginning and end of the fuel injection, which will be described later in detail.

The nozzle body 3 slidably supports the nozzle needle 2 therewithin and includes a pressure chamber 31, injection holes 32, the valve seat 33 and a sack chamber 34. The pressure chamber 31 is defined between the inner peripheral wall of the nozzle body 3 and the outer periphery of the nozzle needle 2 and is constantly fed with the high pressure fuel from the common rail 11 via the inlet port 58 and a fuel feed passage 51 which connects the inlet port 58 to the pressure chamber 31. The valve seat 33 is provided upstream of the injection holes 32 with respect to the flow direction of the high pressure fuel. Accordingly, when the contact portion 21 of the nozzle needle 2 is seated on the valve seat 33 to block a communication between the pressure chamber 31 and the sack chamber 34, no fuel is injected into the engine cylinder via the injection holes 32. On the other hand, when the contact portion 21 of the nozzle needle 2 is separated from the valve seat 33 to establish the communication between the pressure chamber 31 and the sack chamber 34, the high pressure fuel is injected into the engine cylinder via the injection holes 32.

As shown in FIG. 4, the hydraulic piston 4 is drivingly connected to the nozzle needle 2 via a push rod 41 constantly urged toward the valve seat 33 by the force of a coil spring 42. The operations of the hydraulic piston 4 will be described later in detail.

The nozzle holder 5 is formed therein with the inlet port 58, the fuel feed passage 51 and a cylindrical stepped bore 59. The stepped bore 59 includes first and second chambers 52 and 53. The first chamber 52 is arranged at one end of the nozzle holder 5 remote from the valve seat 33 and opens toward the three-way solenoid valve 6. The second chamber 53 is of a smaller diameter than that of the first chamber 52 and extends toward the valve seat 33 to slidably receive therein the cylindrical hydraulic piston 4.

As clearly shown in FIG. 5, the first chamber 52 is opened at an end surface 54 of the nozzle holder 5 and defined between an annular step 55 of the stepped bore 59 and an end surface 60 of the three-way solenoid valve 6. The annular step 55 and the end surface 60 respectively serve as valve seats for a pressure control valve member 7. The pressure control valve member 7 is slidably received in the first chamber 52 and is formed with an orifice 73 at its center. The orifice 73 extends through the pressure control valve member 7 in the longitudinal direction of the nozzle needle 2 and the hydraulic piston 4, that is, from a side of an end surface 72 facing the three-way solenoid valve 6 into a cylindrical central recess 75 formed at a side of an end surface 71 facing the hydraulic piston 4. The outer periphery 74 of the pressure control valve 7 and the peripheral wall of the first chamber 52 cooperatively provide a fluid-tight sealing effect therebetween.

A coil spring 8 is received in the recess 75 of the pressure control valve member 7 at its one end and in a cylindrical central recess 41 of the hydraulic piston 4 at its other end so as to urge both members 7 and 4 in axially opposite directions, that is, urging the pressure control valve member 7 toward the valve seat formed by and surface 60 of the three-way solenoid valve 6 and urging the hydraulic piston 4 toward the valve seat 33.

The pressure control valve member 7 and the hydraulic piston 4 cooperatively define therebetween a pressure control chamber 76 for controlling a hydraulic pressure to be applied to the hydraulic piston 4. As will be described later in detail, the orifice 73 works to control the hydraulic pressure within the pressure control chamber 76 both at the start of the fuel injection and at the termination thereof.

As shown in FIG. 4, the three-way solenoid valve 6 includes a coil 61, an inner valve member 62, an outer valve member 63 and a valve body 64.

The inner valve member 62 is slidably received in the outer valve member 63. The outer valve member 63 is slidably received in the valve body 64 and formed therein with a hydraulic passage 65. The valve body 64 is formed therein with a communication passage 66, a high pressure passage 67, a low pressure or drain passage 68 and a valve chamber 69 which slidably receives the outer valve member 63.

The communication passage 66 communicates with the first chamber 52 at its one end and with the valve chamber 69 at its other end. The high pressure passage 67 communicates with the fuel feed passage 51 at its one end and with the valve chamber 69 at its other end. Accordingly, the high pressure fuel is constantly fed into the high pressure 67 via the fuel feed passage 51. The drain passage 68 communicates with the valve chamber 69 at its one end and with a low pressure side 12 at its other end.

When the coil 61 is energized, the cooperation of the inner and outer valve members 62 and 63 blocks the communication between the high pressure passage 67 and the communication passage 66, while, establishes the communication between the communication passage 66 and the drain passage 68 via the valve chamber 69 in a known manner. Accordingly, the high pressure fuel in the pressure control chamber 76 is discharged into the low pressure side 12 via the orifice 73.

On the other hand, when the coil 61 is deenergized as shown in FIG. 4, the cooperation of the inner and outer valve members 62 and 63 blocks the communication between the communication passage 66 and the drain passage 68, while, establishes the communication between the high pressure passage 67 and the communication passage 66 via the hydraulic passage 65 in a known manner. Accordingly, the high pressure is applied to the pressure control valve member 7 from the side of the communication passage 66.

Now, the operation of the first preferred embodiment will be described with reference to FIGS. 4 to 12.

FIG. 7 shows the state where the coil 61 of the three-way solenoid valve 6 is de-energized so that the high pressure is applied to the pressure control valve member 7 from the communication passage 66 and further the hydraulic pressure across the pressure control valve member 7 is balanced, that is, the hydraulic pressure within the pressure control chamber 76 is maximum. In this condition, the hydraulic piston 4 is forced to a position where the nozzle needle 2 is seated on the valve seat 33, which corresponds to a lift position A in part (B) of the graph in FIG. 12. This lift position A is a fully closed valve position which is attained when the hydraulic piston 4 moves to the position at a predetermined distance Dp from the annular step 55. Since the nozzle needle 2 is seated on the valve seat 33, the communication between the pressure chamber 31 and the sack chamber 34 is blocked so that no fuel is injected from the injection holes 32. Further, since the hydraulic pressure across the pressure control valve member 7 is balanced, the pressure control valve member 7 is forced by the force of the spring 8 to rest on the valve seat formed by end surface 60 of the three-way solenoid valve 6.

When the coil 61 of the three-way solenoid valve 6 is energized in the state of FIG. 7, the communication passage 66 is communicated with the low pressure side 12 so that the high pressure fuel in the pressure control chamber 76 is gradually discharged via the orifice 73 to gradually decrease the hydraulic pressure in the pressure control chamber 76 as shown in part (A) of the graph in FIG. 12. When the hydraulic pressure in the pressure control chamber 76 is reduced to a predetermined valve opening pressure, i.e. the hydraulic pressure in the nozzle body 3 applied to the nozzle needle 2 at a side axially opposite to the pressure control chamber 76 is balanced with the sum of the forces of the coil springs 8 and 42 and the hydraulic pressure in the pressure control chamber 76 applied to the hydraulic piston 4, the hydraulic piston 4 starts to gradually displace upward or toward the pressure control valve member 7 as shown in FIG. 8. Simultaneously, the contact portion 21 of the nozzle needle 2 starts to gradually separate from the valve seat 33 as shown in part (B) of the graph in FIG. 12 so that the pressure chamber 31 is communicated with the sack chamber 34 to start the fuel injection via the injection holes 32.

Subsequently, as the hydraulic pressure in the pressure control chamber 76 gets smaller, the hydraulic piston 4 is further forced toward the pressure control valve member 7 to allow the nozzle needle 2 to gradually reach a lift position B in part (B) of the graph in FIG. 12. This lift position B is a fully opened valve position which is attained when the hydraulic piston 4 is displaced extremely toward the pressure control valve member 7, i.e. the hydraulic pressure in the pressure control chamber 76 is minimum. As shown in parts (A) and (B) of the graph in FIG. 12, until the hydraulic pressure in the pressure control chamber 76 reaches a predetermined valve closing pressure, the nozzle needle 2 remains at a lift position C which is equal in level to the lift position B.

As shown in FIG. 9, when the coil 61 of the three-way solenoid valve 6 is de-energized, the high pressure fuel is introduced into the communication passage 66 to urge the pressure control valve member 7 toward the hydraulic piston 4. Since the force of the coil spring 8 is set very small, the pressure control valve member 7 is immediately displaced from the valve seat 60 to be seated onto the annular step 55 as shown in FIG. 10. This displacement of the pressure control valve member 7 causes an immediate pressure increase in the pressure control chamber 76 to the valve closing pressure as shown in part (A) of the graph in FIG. 12. Accordingly, the hydraulic piston 4 is quickly forced toward the valve seat 33 to displace the nozzle needle 2 to a lift position D which is located immediately before the valve seat 33 or immediately adjacent to the valve seat 33.

After the pressure control valve member 7 is seated on the annular step 55, the high pressure fuel is introduced into the pressure control chamber 76 via the orifice 73. Since the orifice 73 throttles the flow of the high pressure fuel introduced into the pressure control chamber 76, the hydraulic pressure in the pressure control chamber 76 is gradually increased to slowly displace the nozzle needle 2 further toward the valve seat 33 via the hydraulic piston 4. As appreciated, the introduction speed of the high pressure fuel into the pressure control chamber 76 is adjusted by changing a diameter of the orifice 73. When the hydraulic piston 4 reaches the position at the distance of Dp from the annular step 55 as shown in FIG. 11, the nozzle needle 2 returns to a lift position E which is equal in level to the lift position A as shown in parts (B) of the graph in FIG. 12 so that the contact portion 21 of the nozzle needle 2 is seated on the valve seat 33 to cut-off the fuel injection via the injection holes 32.

Figure 1:
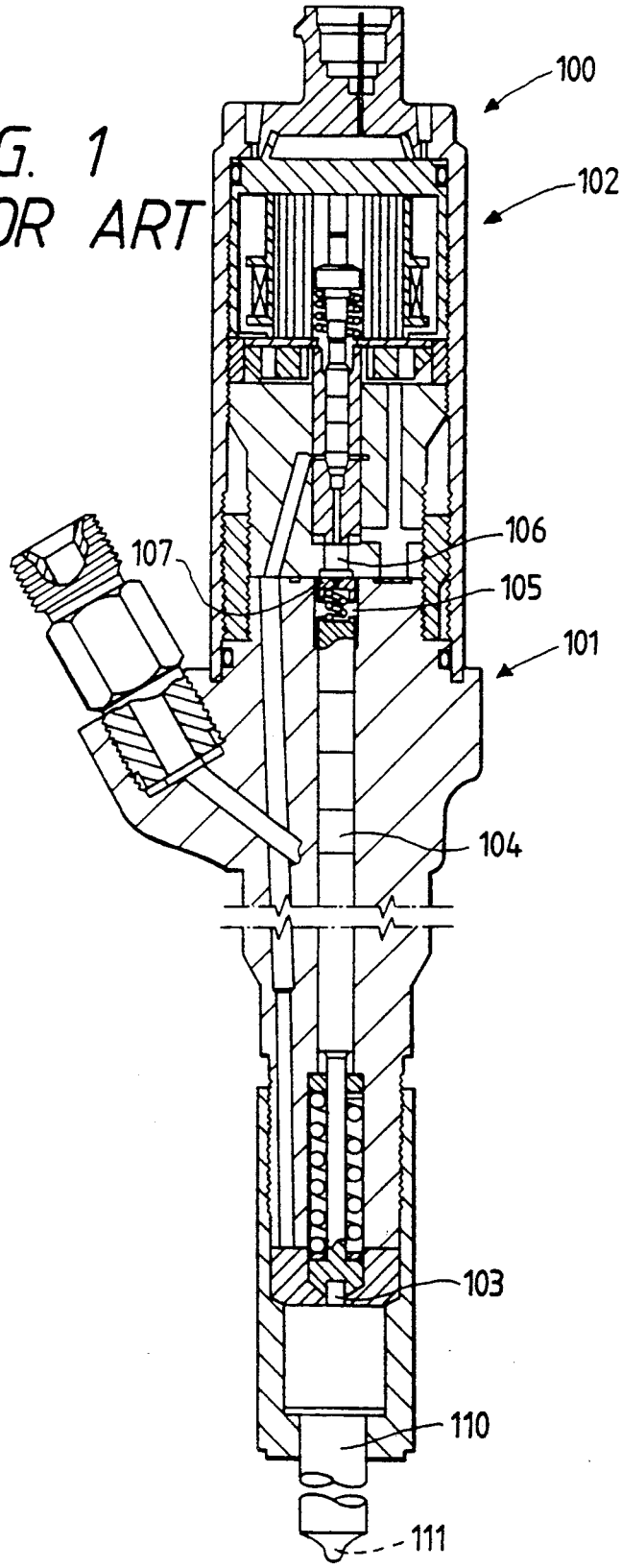
FIG. 1 PRIOR ART
FIG. 1 is a sectional view showing a conventional fuel injection device to be used in a common-rail fuel injection system for a diesel engine.
Figure 2:
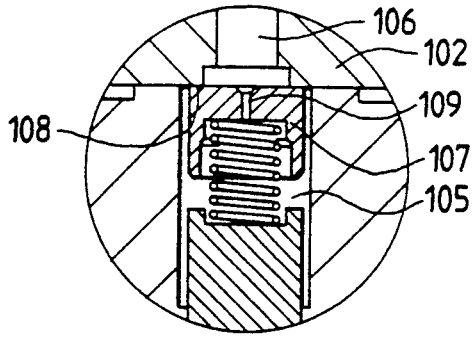
FIG. 2 PRIOR ART
FIG. 2 is a sectional view showing a portion of the fuel injection device in FIG. 1, wherein an arrangement of associated members for controlling a hydraulic pressure applied to a hydraulic piston is shown.
Figure 3:
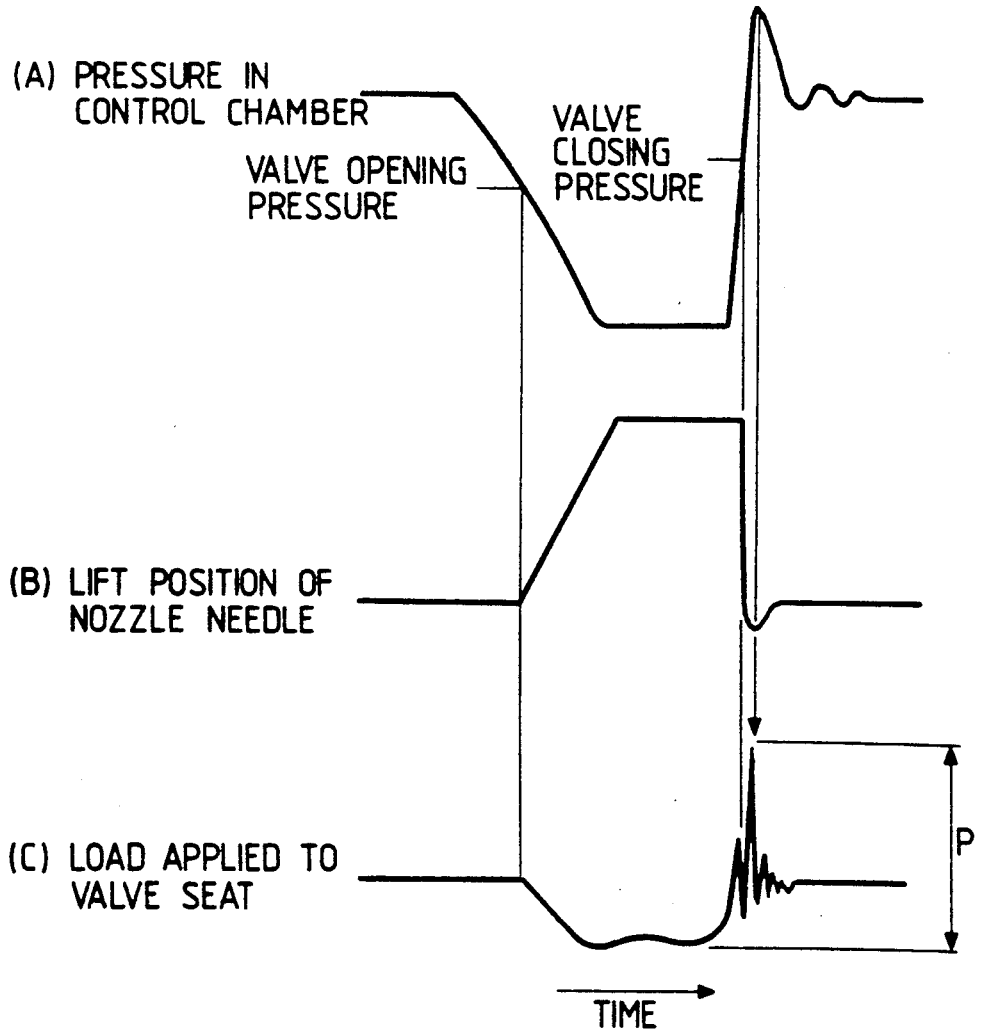
FIG. 3 PRIOR ART
FIG. 3 is a timechart showing a relationship of variations among a hydraulic pressure in a pressure control chamber, a lift position of a nozzle needle and a load applied to a valve seat for the nozzle needle, which is derived by the prior art of FIGS. 1 and 2.

Since the hydraulic pressure in the pressure control chamber 76 is gradually increased by means of the orifice 73 to slowly displace the nozzle needle 2 toward the valve seat 33 after the nozzle needle 2 reaches the lift position D, no overshooting of the hydraulic pressure is generated in the pressure control chamber 76 as shown in part (A) of the graph in FIG. 12, as opposed to the prior art of part (A) of the graph in FIG. 3. As a result, an impact load P={(upper peak value)−(lower peak value)} is significantly lowered as shown in part (C) of the graph in FIG. 12 in comparison with the impact load P in part of (C) of the graph in FIG. 12.

As shown in part (C) of the graph in FIG. 12, the load applied to the valve seat 33 is lowered during the fuel injection since the contact portion 21 of the nozzle needle 2 is separated therefrom, which, however, cannot be reduced to zero due to the high pressure fuel from the common rail 11 being applied thereto during the fuel injection.

As appreciated from the foregoing description of the first preferred embodiment, the hydraulic pressure applied to the hydraulic piston 4 is so controlled as to reduce the speed of the movement of the nozzle needle 2 toward the valve seat 33 after the nozzle needle 2 reaches immediately before the valve seat 33. Accordingly, the impact load P applied to the valve seat 33, which otherwise becomes excessively high, is significantly reduced. Further, since the speed of the nozzle needle 2 is lowered only after the nozzle needle 2 reaches immediately before the valve seat 33, the sharp cut-off of the fuel injection is effectively ensured satisfying the required fuel injection characteristics.

FIG. 13 shows a modification of the first preferred embodiment. In FIG. 13, the same or like members or components are designated by the same reference numerals as in the first preferred embodiment. In this modification, an annular gap of a predetermined width is provided between the outer periphery 74 of the pressure control valve member 7 and the peripheral wall of the first chamber 52. Accordingly, in this modification, it is so designed that the fluid-tight sealing is securely provided between the end surface 71 of the pressure control valve member 7 and the annular valve seat 55 and between the end surface 72 of the pressure control valve member 7 and the valve seat 60 when the pressure control valve member 7 is selectively seated on the respective valve seats. The width of the annular gap should be set small enough to ensure substantially the same operation of the pressure control valve member 7 as in the first preferred embodiment.

FIG. 14 shows another modification of the first preferred embodiment, wherein the same or like members or components are designated by the same reference numerals as in the first preferred embodiment. In this modification, the annular step 55 is formed tapering toward the second chamber 53 and a corresponding tapering surface 77 is formed on the pressure control valve member 7. In this modification, the fluid-tight sealing may be provided between the outer periphery 74 of the pressure control valve member 7 and the peripheral wall of the first chamber 52 as in the first preferred embodiment, or, instead of this, the fluid-tight sealing may be provided between the end surface 72 of the pressure control valve member 7 and the valve seat 60 and between the tapering annular surface 77 of the pressure control valve member 7 and the tapering annular step 55.

Now, a second preferred embodiment of the fuel injection system according to the present invention will be described with reference to FIGS. 15 to 19. In these figures, the same or like members or components are designated by the same reference numerals as in the first preferred embodiment. Further, the other structures not shown in these figures are the same as in the first preferred embodiment.

In the second preferred embodiment, as shown in FIG. 15, the first chamber 52 includes first and second pressure control valve members 7*a* and 7*b* instead of the pressure control valve member 7 in the first preferred embodiment, and accordingly may have a longer axial length than that in the first preferred embodiment. The first pressure control valve member 7*a* is disposed between the hydraulic piston 4 and the second pressure control valve member 7*b* so as to form a first pressure control chamber 76*a* between the first valve member 7*a* and the hydraulic piston 4 and a second pressure control chamber 76*b* between the first and second valve members 7*a* and 7*b*. The first and second valve members 7*a* and 7*b* have the same diameter which is smaller than that of the first chamber 52 to provide annular gaps of a predetermined width between the peripheral wall of the first chamber 52 and the outer periphery of each of the first and second valve members 7*a* and 7*b*.

The first valve member 7*a* has a recessed portion 78*a* at a side facing the second valve member 7*b* which has a corresponding projected portion 78*b* received in the recessed portion 78*a*. The coil spring 8 is disposed between the first and second valve members 7*a* and 7*b* for urging them in opposite directions, i.e. urging the first valve member 7*a* toward the hydraulic piston 4 and urging the second valve member 7*b* toward the communication passage 66.

The first valve member 7*a* has an orifice 73*a* axially extending through the center of the first valve member 7*a* from a side of an end surface 72*a* of the second pressure control chamber 76*b* to a side of an end surface 71*a* of the first pressure control chamber 76*a*. Similarly, the second valve member 7*b* has an orifice 73*b* axially extending through the center of the second valve member 7*b* from a side of an surface 72*b* or the communication passage 66 to a side of an end surface 71*b* of the second pressure control chamber 76*b*. The orifices 73*a* and 73*b* are arranged in alignment with each other.

Now, operations of the second preferred embodiment will be described with reference to FIGS. 15 to 19.

FIG. 15 shows the state where the coil 61 of the three-way solenoid valve 6 is de-energized so that the high pressure is applied to the first chamber 52 from the communication passage 66 and further the hydraulic pressures in the first and second pressure control chambers 76*a* and 76*b* are maximum. In this condition, the hydraulic piston 4 is forced to a position where the nozzle needle 2 is seated on the valve seat 33, which corresponds to a lift position A in FIG. 19. This lift position A is a fully closed valve position which is attained when the hydraulic piston 4 moves a predetermined distance Dp from the annular step 55 or from the end surface 71*a* of the first valve member 7*a*. Since the nozzle needle 2 is seated on the valve seat 33, the communication between the pressure chamber 31 and the sack chamber 34 is blocked so that no fuel is injected from the injection holes 32. Further, since the hydraulic pressure across the second valve member 7*b* is balanced, the second valve member 7*b* is forced by the force of the spring 8 to rest on the valve seat 60 of the three-way solenoid valve 6.

When the coil 61 of the three-way solenoid valve 6 is energized in the state of FIG. 15, the communication passage 66 is communicated with the low pressure side 12 so that the high pressure in the first pressure control chamber 76*a* is gradually discharged via the orifices 73*a* and 73*b* and the high pressure in the second pressure control chamber 76*b* is gradually discharged via the orifice 73*b*. Accordingly, the hydraulic pressures in the first and second pressure control chambers 76*a* and 76*b* are gradually decreased. When the hydraulic pressure in the first pressure control chamber 76*a* is reduced to a predetermined valve opening pressure, the hydraulic piston 4 starts to gradually displace upward or toward the first valve member 7*a*. Simultaneously, the contact portion 21 of the nozzle needle 2 starts to gradually separate from the valve seat 33 or gradually displace from the lift position A as shown in FIG. 19 so that the pressure chamber 31 is communicated with the sack chamber 34 to start the fuel injection via the injection holes 32.

After moving the predetermined distance Dp, the hydraulic piston 4 contacts the end surface 71*a* of the first valve member 7*a* to urge the latter toward the second valve member 7*b*. Simultaneously, the decreasing hydraulic pressure in the second pressure control chamber 76*b* allows the hydraulic piston 4 to slowly displace the first valve member 7*a* from the annular step 55 to reach the state as shown in FIG. 16. In FIG. 16, the hydraulic piston 4 and the first valve member 7*a* are displaced extremely toward the second valve member 7*b* to force the nozzle needle 2 to a lift position B in FIG. 19. This lift position B is a fully opened valve position which is attained when the hydraulic pressure in the second pressure control chamber 76*b* is minimum. Until the hydraulic pressure in the second pressure control chamber 76*b* reaches a predetermined valve closing pressure, the nozzle needle 2 remains at a lift position C which is equal in level to the lift position B.

When the coil 61 of the three-way solenoid valve 6 is de-energized in the state of FIG. 16, the high pressure fuel is introduced into the communication passage 66 to urge the second valve member 7*b* toward the first valve member 7*a*. Since the force of the coil spring 8 is set very small, the second valve member 7*b* is immediately separated from the valve seat 60 as shown in FIG. 17. This displacement of the second valve member 7*b* allows the high pressure fuel in the communication passage 66 to be immediately introduced into the second pressure control chamber 76*b* via the annular gap provided between the outer periphery of the second valve member 7*b* and the peripheral wall of the first chamber 52. Accordingly, an immediate pressure increase over the valve closing pressure is caused in the second pressure control chamber 76b to quickly displace the first valve member 7a to be seated onto the annular step 55, which is also shown in FIG. 17.

This displacement of the first valve member 7a forces the hydraulic piston 4 toward the valve seat 33 so that the hydraulic piston 4 reaches a position on a level with the annular step 55 as seen in FIG. 17. Simultaneously, the nozzle needle 2 is quickly displaced to a lift position D in FIG. 19 which is located immediately before the valve seat 33 or immediately adjacent to the valve seat 33.

After the first valve member 7a is seated on the annular step 55, the high pressure fuel is introduced into the first pressure control chamber 76a via the first orifice 73a. Since the first orifice 73a throttles the flow of the high pressure fuel introduced into the first pressure control chamber 76a, the hydraulic pressure in the first pressure control chamber 76a is gradually increased to slowly displace the nozzle needle 2 further toward the valve seat 33 via the hydraulic piston 4. When the hydraulic piston 4 moves the predetermined distance Dp from the annular step 55 as shown in FIG. 18, the nozzle needle 2 returns to a lift position E which is equal in level to the lift position A as shown in FIG. 19 so that the contact portion 21 of the nozzle needle 2 is seated on the valve seat 33 to cut-off the fuel injection via the injection holes 32.

Since the hydraulic pressure in the first pressure control chamber 76a is gradually increased by means of the orifice 73a to slowly displace the nozzle needle 2 toward the valve seat 33 after the nozzle needle 2 reaches the lift position D, an impact load applied to the valve seat 33, which is excessively high in the prior art of FIG. 3(C), is significantly lowered similar to the impact load P in the first preferred embodiment of FIG. 12(C).

After the hydraulic pressure across the second valve member 7b is balanced, the second valve member 7b is seated on the valve seat 60 as shown in FIG. 15.

As appreciated from the foregoing description of the second preferred embodiment, the similar effects as in the first preferred embodiment are attained for controlling the hydraulic pressure applied to the hydraulic piston 4 to finally control the behavior of the nozzle needle 2.

In the second preferred embodiment, the annular step 55 and the valve seat 60 may respectively form inclined surfaces or curved surfaces for abutment with the corresponding surfaces of the first and second valve members 7a and 7b. On the other hand, the first and second valve members 7a and 7b may respectively form inclined surfaces or curved surfaces for abutment with the corresponding surfaces of the annular step 55 and the valve seat 60.

It is to be understood that this invention is not to be limited to the preferred embodiments and modifications described above, and that various changes and modifications may be made without departing from the spirit and scope of the invention as defined in the appended claims. For example, the three-way solenoid valve 6 may be replaced by a plurality of solenoid valves of another type. The nozzle needle body 3, the nozzle holder 5 and the valve body 64 may be formed integral, or may be formed by two members or by more than four members. The push rod 41 may be omitted so that the hydraulic piston 4 directly drives the nozzle needle 2. Further, the coil spring 8 may be omitted. This means that, without the coil spring 8, the similar effects can be attained in view of controlling the hydraulic pressure applied to the hydraulic piston 4.

What is claimed is:

1. A fuel injection system for an engine, comprising:

fuel injection means including a valve member and a valve seat, said valve member movable between a first position where the valve member is separated from the valve seat to allow a fuel injection via an injection opening into the engine, and a second position where the valve member is seated on the valve seat to inhibit the fuel injection via said injection opening; and control means for controlling a hydraulic pressure applied to said valve member to displace the valve member between said first and second positions, said control means immediately increasing the hydraulic pressure applied to the valve member when the valve member is displaced from the first position to a third position which is located between said first and second positions, and gradually increasing the hydraulic pressure applied to the valve member when the valve member is displaced from said third position to the second position.

2. The system as set forth in claim 1, wherein said third position is located immediately adjacent to the second position.

3. The system as set forth in claim 1, wherein said third position is located immediately before the second position when the valve member is displaced toward the second position.

4. The system as set forth in claim 1, wherein said control means includes pressure control valve means having pressure throttle means, and pressure switching means for selectively applying a high hydraulic pressure to the pressure control valve means, said pressure control valve means applying said high hydraulic pressure to said valve member via said pressure throttle means for gradually increasing the hydraulic pressure applied to said valve member to displace the valve member from the third position to the second position.

5. The system as set forth in claim 1, wherein said valve member is a nozzle needle and said controlled hydraulic pressure is applied to said nozzle needle via driving means mechanically connected to the nozzle needle at a side opposite to said valve seat.

6. The system as set forth in claim 5, wherein said driving means includes a cylindrical piston and said control means includes a cylindrical stepped bore having therein an annular step which defines a first section and a second section having a smaller diameter than that of the first section, said second section located closer to said valve seat than the first section and slidably receiving therein said cylindrical piston, said control means further including pressure control valve means movably disposed in the first section so as to define a pressure control space between said cylindrical piston and said pressure control valve means for controlling the hydraulic pressure applied to the cylindrical piston, said pressure control valve means including pressure throttle means therein, and wherein said control means further includes pressure switching means for selectively applying a high hydraulic pressure to said first section to quickly displace the pressure control valve means toward said cylindrical piston to contact with said annular step so as to allow said high hydraulic pressure to be introduced into said pressure control space only through said pressure throttle means.

7. The system as set forth in claim 6, wherein said displacement of the pressure control valve means toward said cylindrical piston quickly displaces the cylindrical piston so that the nozzle needle is quickly displaced from the first position to the third position, and wherein said introduction of the high hydraulic pressure into the pressure control space through the pressure throttle means gradually increases the hydraulic pressure in the pressure control space to slowly displace the cylindrical piston so that the nozzle needle is displaced from the third position to the second position.

8. The system as set forth in claim 7, wherein said pressure switching means alternatively establishes a communication between said first section and a high pressure side to apply the high hydraulic pressure to said first section and a communication between said first section and a low pressure side to discharge the high hydraulic pressure from the first section into the low pressure side.

9. The system as set forth in claim 8, wherein said pressure control valve means includes a cylindrical valve member movably disposed in the first section to define said pressure control space between the cylindrical valve member and the cylindrical piston, and said pressure throttle means includes an orifice extending through the cylindrical valve member into the pressure control space from a side opposite to the pressure control space, and wherein said cylindrical valve member is quickly displaced toward the cylindrical piston to contact with the annular step so as to allow the high hydraulic pressure to be introduced into the pressure control space only through said orifice when the pressure switching means establishes the communication between the first section and the high pressure side, said quick displacement of the valve member immediately increasing the hydraulic pressure in the pressure control space to quickly displace the cylindrical piston such that the nozzle needle is quickly displaced from the first position to the third position, and wherein said introduction of the high hydraulic pressure into the pressure control space through the orifice gradually increases the hydraulic pressure in the pressure control space to slowly displace the cylindrical piston such that the nozzle needle is slowly displaced from the third position to the second position.

10. The system as set forth in claim 9, wherein an outer periphery of the cylindrical valve member and a peripheral wall of the first section cooperatively provide a fluid-tight sealing therebetween.

11. The system as set forth in claim 9, wherein said cylindrical valve member has a diameter smaller than that of the first chamber to provide an annular gap of a predetermined width therebetween.

12. The system as set forth in claim 8, wherein said pressure control valve means includes first and second cylindrical valve members movably disposed in the first section in alignment with the cylindrical piston, said first valve member disposed between the cylindrical piston and the second valve member to define said pressure control space between the first valve member and the cylindrical piston and a further pressure control space between the first and second valve members, and said pressure throttle means includes first and second orifices, said first orifice extending through the first valve member into the pressure control space from said further pressure control space and said second orifice extending through the second valve member into said further pressure control space from a side opposite to said further pressure control space, and wherein said second cylindrical valve member is quickly displaced toward the first valve member to immediately introduce the high hydraulic pressure into the further pressure control space through an annular gap formed between an outer periphery of the second valve member and a peripheral wall of the first section when the pressure switching means establishes the communication between the first section and the high pressure side, said immediate introduction of the high hydraulic pressure into the further pressure control space immediately increasing the hydraulic pressure therein to quickly displace the first valve member to contact with the annular step so as to allow the high hydraulic pressure to be introduced into the pressure control space only through said first orifice, said quick displacement of the first valve member directly pushing the cylindrical piston such that the nozzle needle is quickly displaced from the first position to the third position, and wherein said introduction of the high hydraulic pressure into the pressure control space through the first orifice gradually increases the hydraulic pressure in the pressure control space to slowly displace the cylindrical piston such that the nozzle needle is slowly displaced from the third position to the second position.

13. The system as set forth in claim 9, wherein a coil spring is disposed between the cylindrical valve member and the cylindrical piston to urge the cylindrical piston toward the valve seat and the cylindrical valve member in a direction opposite to the valve seat.

14. The system as set forth in claim 12, wherein a coil spring is disposed between the first and second cylindrical valve members to urge the first cylindrical valve member toward the cylindrical piston and the second cylindrical valve member in a direction opposite to the cylindrical piston.

15. The system as set forth in claim 8, wherein said pressure control valve means blocks the communication between the first section and the low pressure side when the pressure switching means establishes the communication between the first section and the low pressure side such that the first section is communicated with the low pressure side only through the pressure throttle means to gradually decrease the hydraulic pressure in the pressure control space.

16. A fuel injection system for an engine, comprising:

fuel injection means including a valve member and a valve seat, said valve member movable between a first position where the valve member is separated from the valve seat to allow a fuel injection via an injection opening into the engine, and a second position where the valve member is seated on the valve seat to inhibit the fuel injection via said injection opening; and control means for controlling a hydraulic pressure applied to said valve member to displace the valve member between said first and second positions, said control means controlling said hydraulic pressure so as to quickly displace the valve member from the first position to a third position which is located between said first and second positions and slowly displace the valve member from the third position to the second position.

* * * * *